US007111766B2

(12) United States Patent
Eigenmann

(10) Patent No.: US 7,111,766 B2
(45) **Date of Patent: *Sep. 26, 2006**

(54) APPARATUS FOR AND A METHOD OF AN INTERMITTENT FEEDING OF A STRIP SHAPED BLANK TO A PRESS

(75) Inventor: Oskar Eigenmann, Arbon (CH)

(73) Assignee: Bruderer AG, Frasnacht (CH)

( * ) Notice: Subject to any disclaimer, the term of this patent is extended or adjusted under 35 U.S.C. 154(b) by 147 days.

This patent is subject to a terminal disclaimer.

(21) Appl. No.: 10/644,074

(22) Filed: Aug. 19, 2003

(65) Prior Publication Data

US 2004/0069108 A1 Apr. 15, 2004

(30) Foreign Application Priority Data

Aug. 22, 2002 (EP) ..... 02018251

(51) Int. Cl.
*B65H 20/00* (2006.01)

(52) U.S. Cl. ..... 226/154; 226/152; 226/155

(58) Field of Classification Search ..... 226/152, 226/154, 155, 35, 90, 142, 179, 188
See application file for complete search history.

(56) References Cited

U.S. PATENT DOCUMENTS 3,244,023 A 4/1966 Baringer et al. ..... 74/600
3,638,846 A * 2/1972 Wiig ..... 226/142
4,792,074 A * 12/1988 Bareis et al. ..... 226/149
5,062,561 A * 11/1991 Messner ..... 226/152
5,102,026 A 4/1992 Messner ..... 226/156
5,110,026 A 5/1992 Messner ..... 226/152
5,163,595 A 11/1992 Messner ..... 226/154
5,197,645 A * 3/1993 Nordlof ..... 226/154
5,868,296 A * 2/1999 Gentile et al. ..... 226/35
5,992,722 A * 11/1999 Strick et al. ..... 226/152
6,662,988 B1 * 12/2003 Eigenmann ..... 226/142

FOREIGN PATENT DOCUMENTS

EP 0 370 258 5/1990

* cited by examiner

*Primary Examiner*—Kathy Matecki
*Assistant Examiner*—Evan Langdon
(74) *Attorney, Agent, or Firm*—Ladas & Parry LLP

(57) ABSTRACT

The elongate rocker is forked at its first end and includes two fork tines. These are designed symmetrically relative to the longitudinal plane of symmetry of the rocker. A control rod with a longitudinal center axis is pivotally mounted at its bottom end to the second end of the rocker. A spiral pressing spring with a longitudinal center axis acts onto the rocker. The upper feeding roller is designed symmetrically to a plane extending perpendicularly relative to its longitudinal center axis. The longitudinal center axis of the control rod defines together with the longitudinal center axis of the pressing spring a geometrical plane. This plane coincides with the longitudinal plane of symmetry of the rocker, which in turn coincides with the geometrical plane which extends perpendicularly to the longitudinal center axis.

11 Claims, 11 Drawing Sheets

APPARATUS FOR AND A METHOD OF AN INTERMITTENT FEEDING OF A STRIP SHAPED BLANK TO A PRESS

CROSS REFERENCE TO RELATED APPLICATIONS

This application claims the priority of the European patent application No. 02 018 251.5-2302, filed on Aug. 22, 2002 of which the disclosure shall be considered incorporated herein by reference.

BACKGROUND OF THE INVENTION

1. Field of the Invention

The present invention relates to an apparatus for a intermittent feeding of a strip shaped blank to a press equipped with tools for a intermittent working of the strip shaped blank, said feeding apparatus having a housing, a first feeding roller and a second feeding roller, which feeding rollers are adapted to accommodate the strip shaped blank arranged between same to be fed, and having a first intermittently operating electric servomotor which is drivingly connected to at least said first feeding roller, which first feeding roller includes a longitudinal axis and is designed symmetrically relative to a plane of symmetry extending perpendicularly to said longitudinal center axis; and having further a elongate rocker which includes a first and a second end which second end is located opposite said first end; which first feeding roller is supported for rotation in said rocker; which second feeding roller is arranged on a roller shaft and is rigidly connected thereto; which rocker is arranged at its first end on a first end area of a rocker shaft and is rigidly connected thereto; which rocker shaft is mounted for rotation at a second end area opposite the first end area in said housing, so that said rocker is supported in a overhung state; further having a means for a lifting off of a feeding roller, which means includes a control rod which is pivotally mounted to said second end of said rocker, which control rod includes a longitudinal center axis; further having a feeding roller pressing on device which includes a spiral spring which rests at one of its ends on said rocker; which spiral pressing spring includes a further longitudinal center axis.

The invention relates also to a method of operating the feeding apparatus as set forth above, said feeding apparatus having a housing and a threaded spindle housing arranged on said housing; having a adjusting motor with a threaded spindle and a control apparatus, a adjusting nut arranged on said threaded spindle and displaceable along same by a rotating of said threaded spindle; having further a eccenter disk driven by a electromotor, on which eccenter disk a connecting rod is supported which at its end remote from said eccenter disk includes a oblong hole extending at least approximately parallel to said threaded spindle; having further a double arm lever device supported on said adjusting nut, and a second double arm lever device supported on a shaft which is supported in said threaded spindle housing; which first double arm lever device has a first arm which engages said connecting rod and a second arm which is pivotally mounted to a fishplate, which in turn is pivotally mounted to a first arm of said double arm lever device, onto a second arm of which a connecting rod unit is pivotally mounted which in turn is pivotally mounted to said rocker; having further a pressure spring located between said rocker and said threaded spindle housing and is adapted to press said rocker with a upper roller shaft supported therein and with the first, upper feeding roller against said lower feeding roller shaft with the second, lower feeding roller; said feeding apparatus having a control device and cooperates with a press having a moveable upper tool and a stationary lower tool, which upper tool is mounted to a punch which is moveable between a upper dead center position and a bottom dead center position; and having a press control device which cooperates with said control feeding apparatus; and in which the oblong hole of the connecting rod which is moveable between a upper dead center position and a bottom dead center position has a upper and a lower end; and in which the first arm of said double arm lever device engages said connecting rod through a bolt which extends through said oblong hole, wherein in order to insert a new strip shaped blank between said upper feeding roller and said lower feeding roller, the upper feeding roller is moved into a high lift position in order to set in this position a predetermined distance between the upper feeding roller and the lower feeding roller.

The invention relates further to a method of operating the feeding apparatus of the kind set forth above, said feeding apparatus having a housing and a threaded spindle housing arranged on said housing; having a adjusting motor with a threaded spindle and a control apparatus, a adjusting nut arranged on said threaded spindle and displaceable along same by a rotating of said threaded spindle; having further a eccenter disk driven by a electromotor on which eccenter disk a connecting rod is supported which at its end remote from said eccenter disk includes a oblong hole extending at least approximately parallel to said threaded spindle; having further a double arm lever device supported on said adjusting nut, and a second double arm lever device supported on a shaft which is supported in said threaded spindle housing; which first double arm lever device has a first arm which engages said connecting rod and a second arm which is pivotally mounted to a fishplate, which in turn is pivotally mounted to a first arm of said double arm lever device, onto a second arm of which a connecting rod unit is pivotally mounted to said rocker; having further a pressure spring located between said rocker and said threaded spindle housing and is adapted to press said rocker with a upper roller shaft supported therein and with its first, upper feeding roller supported therein against said lower roller shaft with the second, lower feeding roller; said feeding apparatus having a control device and cooperates with a press having a moveable upper tool and a stationary lower tool, which upper tool is mounted to a punch which is moveable between a upper dead center position and a bottom dead center position; and having a press control device which cooperates with said control device of the feeding apparatus; and in which the oblong hole of the connecting rod which is moveable between a upper dead center position and a bottom dead center position has a upper and a lower end; and in which the first arm of said first double arm lever device engages said connecting rod through a bolt which extends through said oblong hole.

The invention relates also to method of operating the feeding apparatus as set forth above, said feeding apparatus having a housing and a threaded spindle housing arranged on said housing; having a adjusting motor with a threaded spindle and a control apparatus, a adjusting nut arranged on said threaded spindle and displaceable along same by a rotating of said threaded spindle; having further a eccenter disk driven by a electromotor, on which eccenter disk a connecting rod is supported which at its end remote from said eccenter disk includes a oblong hole extending at least approximately parallel to said threaded spindle; having further a double arm lever device supported on said adjusting nut, and a second double arm lever device supported on a shaft which is supported in said threaded spindle housing; which first double arm lever device has a first arm which engages said connecting rod and a second arm which is pivotally mounted to a fishplate, which in turn is pivotally mounted to a first arm of said double arm lever device, onto a second arm of which a connecting rod unit is pivotally mounted to said rocker; having further a pressure spring located between said rocker and said threaded spindle housing and is adapted to press said rocker with a upper roller shaft supported therein and with the first, upper feeding roller supported therein against said lower roller shaft with the second, lower feeding roller; said feeding apparatus having a control device and cooperates with a press having a moveable upper tool and a stationary lower tool, which upper tool is mounted to a punch which is moveable between a upper dead center position and a bottom dead center position; and having a press control device which cooperates with said control device of the feeding apparatus; and in which the oblong hole of the connecting rod which is moveable between a upper dead center position and a bottom dead center position has a upper and a lower end; and in which the first arm of said first double arm lever device engages said connecting rod through a bolt which extends through said oblong hole, which punch is driven by a rotating drive and the eccenter disk of the connecting rod is driven by a electromotor; which upper tool includes positioning pins adapted to precisely position said strip shaped blank in the press during any working procedure step performed on the strip; which positioning pins are moved into prepunched holes in said strip shaped blank, and which positioning pins include conical head portions, and said first, upper feeding roller is moved away from said second, lower feeding roller into a intermediate lifted position as soon as said conical head portions have been moved partly into the positioning holes, and thereafter moved again back to again rest on the strip shaped blank as soon as the conical head portions have been lifted partly out of the positioning holes.

2. Description of the Prior Art

The presses which herein are referred to are specifically high speed punch presses with a number of strokes up to 2000 strokes per minute. These presses are equipped with tools for a working or processing resp. of a (or several) strip shaped blank(s) fed to the press, whereby punching operations, embossing operations, bending operations, a riveting, a producing of threads are performed.

The movement of the strip shaped blank which is worked upon in the press proceeds, thereby, intermittently, i.e. step-wise. During a given working step, e.g. a punching, quite obviously no feeding movement of the strip-shaped blank occurs. It is often precisely positioned, that is arrested by positioning pins arranged in the tools. After the termination of such a given working step, for instance after a punching tool has been moved out of the punched hole, the strip-shaped blank is advanced, i.e. fed by a predetermined distance and again stopped, so that the next following working step can be performed.

The feeding or forwarding, resp. movement of the strip shaped blank proceeds by a (or several, located at the entry and of the exit of the press) feeding or forwarding, resp. apparatus(es) in order to draw the strip shaped blank intermittently off a storage roll and to feed it intermittently to the press.

The feeding apparatuses include typically feeding members in order to advance the strip shaped blank. It is, thereby, clamped and advanced by these feeding members. When the feeding members return again into their initial position, the clamping state is released. Additionally, the clamping is released for a short time during the time span within which the tools perform a working step on the strip shaped blank, specifically in the case of positioning pins.

The design of these feeding devices must meet basically 3 main functions, namely the high lifting (strip is being inserted), the setting based on the thickness of the strip (the upper feeding roller rests on the strip, play in the oblong hole of the connecting rod), and intermediate lifting (giving the strip free prior to each working step).

Designs of such feeding devices have become known in which the clamping members are designed as linearly moving clamping tongues. Other designs include oscillating segment rollers which perform rotary movements.

Furthermore, feeding apparatuses with electrical servomotors have become known. Thereby, a first servomotor is allocated to the feeding drive of the clamping members and a further, second servomotor is allocated to the intermittent lifting of a clamping member off the strip shaped blank. Such servomotors are made and sold by several companies. The operation of these servomotors is electronically controlled. These new feeding devices comprise as feeding members completely cylinder shaped feeding rollers arranged on shafts which rotate intermittently always in the same sense of rotation. Of these feeding rollers one is supported in a structure which is drivingly connected to a further servomotor, and due to the operation of this structure this feeding roller is moved towards the strip shaped blank for a clamping of same and away from the strip shaped blank in order to release same.

Due to the present high number of strokes, the masses of the moving parts of a feeding apparatus play a large role due to their forces of inertia and their moments of inertia, and have, furthermore, a large influence regarding the precision of the fabricated product. Furthermore, the arrangement and the design of these moving parts must be, due to the time spans for the acceleration and deceleration of movements, such that a operation with a high number of strokes can be performed safely.

Furthermore, it is possible that torsional moments due to influences of forces are generated in individual structural members which can lead to a slanted position of the feeding roller, so that further negative influences leading to a decrease of the precision of the finished product are produced.

SUMMARY OF THE INVENTION

Hence, it is a general object of the invention to provide an apparatus for a intermittent feeding of a strip shaped blank which has a minimum of moving parts and in which those parts which are subject to large accelerations and decelerations have as small as possible masses, which has no drive motors which operate oscillatingly, and in which the locations where forces act which have a influence on the precise position of the feeding roller are selected such that no oblique position of the rollers can occur.

A further object of the invention is to provide a feeding apparatus, wherein the control rod which is pivotally mounted to the rocker, and the spiral spring which rests on the rocker and the first feeding roller are arranged relative to each other in such positions, that the longitudinal center axis of the spiral pressure spring defines a geometrical plane which coincides with the plane of symmetry of the first feeding roller.

Still a further object of the invention is to provide a feeding apparatus in which the first end of the elongate rocker is of a forked design having two fork tines which fork tines are designed symmetrically relative to a longitudinal plane of symmetry of the elongate rocker, and the elongate rocker is arranged relative to the control rod, the spiral pressing spring and the first feeding roller in such a manner, that its plane of symmetry coincides also with the plane of symmetry of the first feeding roller.

A further object of the invention is to provide a twin feeding apparatus having two feeding apparatuses of the kind mentioned above, which apparatuses face each other at their sides which have the first and second feeding rollers.

Still a further object is to provide a method of operating a feeding apparatus of the kind mentioned above, wherein in order so set the high lift position of the upper feeding roller the two control devices are controlled such, that the punch is controlled into its upper dead center position and the punch is controlled into its bottom dead center position.

Yet a further object of the invention is to provide a method of operating the feeding apparatus set forth above, wherein the punch is moved into a position remote from its upper dead center position, the adjusting nut is displaced downwards by a rotating of the threaded spindle until the first, upper feeding roller rests onto the strip-shaped blank due to the pressure exerted by the pressure spring onto the rocker, in which position the bolt is at a distance from both ends of the oblong hole, so that stroke movements of the connecting rod are possible at a stationary state of the bolt.

It is also a object of the invention to provide a method of operating the feeding apparatus of the kind mentioned above, wherein in order to set the intermediate lifted position the punch is moved by its rotating drive into a angular position ahead of its bottom dead center position, in which angular position the conical head portions of the positioning pins are immersed only partly into the positioning holes, in which state the eccenter disk of the connecting rod is moved into a angular position ahead of the upper dead center position, whereby the angular distance of the punch between mentioned angular position and the bottom dead center position equals the angular distance of the eccenter disk between its said angular position and the upper dead center position, wherein thereafter the adjusting nut is moved downwards so that the bolt comes to rest on the lower end of the oblong hole and the adjusting nut is moved still further downwards until the strip shaped blank is loose due to the lifting of the first, upper feeding roller due to the movement transmitted through the lever device and the control rod unit and the rocker, and wherein the position of the adjusting nut for mentioned angular position of the eccenter disk which has been reached and the corresponding angular position of the punch are stored in the corresponding control devices.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
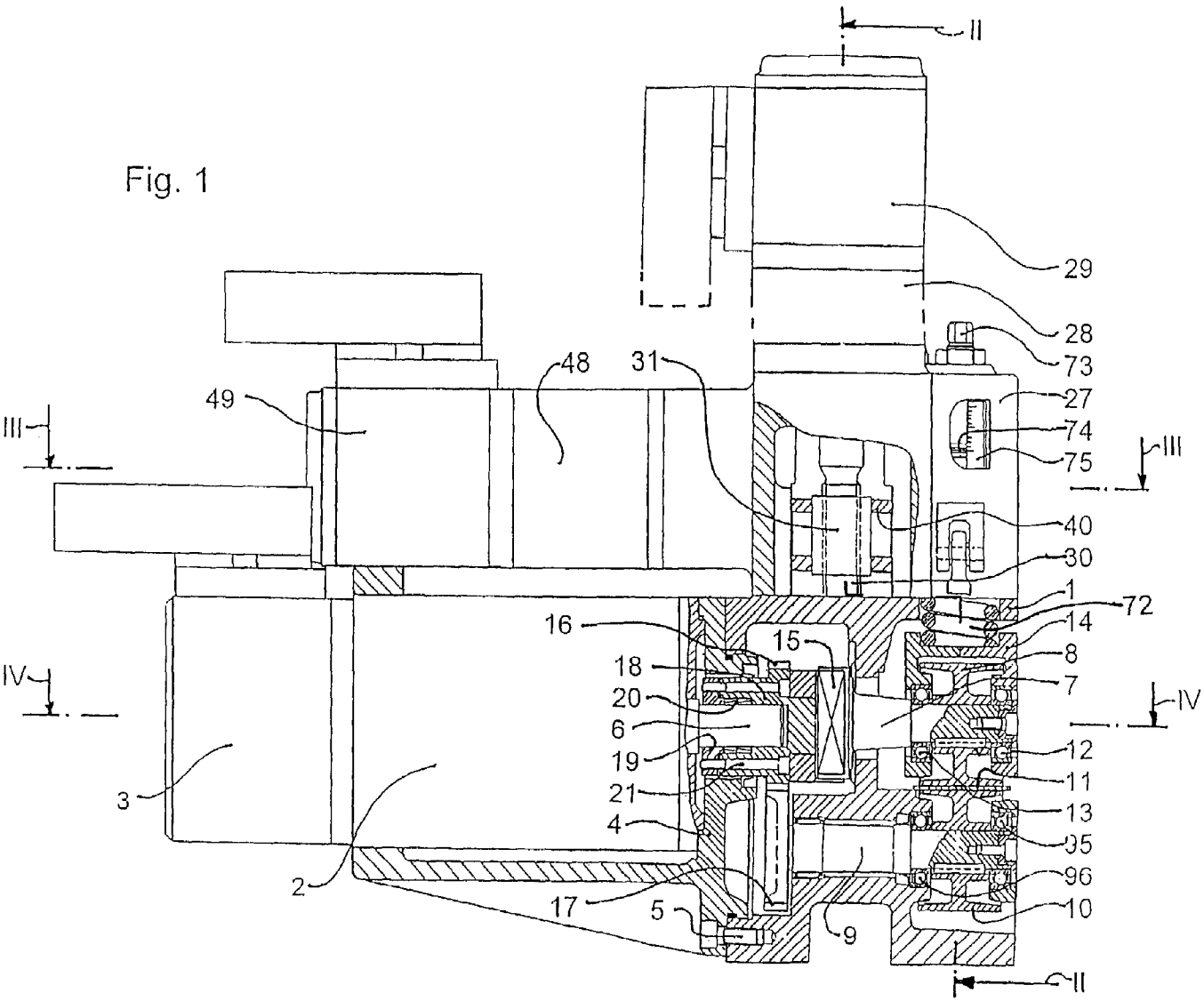
FIG. 1 is a sideview of a feeding apparatus, illustrated partly in section along line I—I of FIG. 2.

The apparatus includes a housing 1. A first electrical servomotor 2, of which the electronic control device 3 is depicted in a simplified manner is mounted at its flange 4 through threaded bolts 5 to the housing 1.

This first electrical servomotor 2 is controlled in a manner generally known to the person skilled in the art that it performs step-wise intermittent rotary movements. The duration and magnitude of a respective step of the rotary movements are controlled in dependence from the work being performed by the adjacent following punch press. This servomotor 2 includes a drive shaft 6.

The feeding apparatus includes, furthermore, a upper roller shaft 7 on which a first, upper feeding roller is arranged, and includes a lower roller shaft 9 on which a second, lower feeding roller 10 is arranged, The strip like blank, generally a metal strip which is to be fed intermittently is identified by the reference numeral 11. For the feeding movement this strip like blank is located in a clamped state between the first, upper feeding roller 8 and the second, lower feeding roller 10. The first, upper feeding roller 8 includes a longitudinal center axis 87, see FIG. 14.

The upper shaft 7 is supported through roller bearings 12, 13 in a rocker 14 which will be described in detail further below.

The lower shaft 9 is supported through roller bearings 95, 96 in the housing 1.

According to the illustrated, preferred embodiment the upper shaft 7 is drivingly connected to the first electrical servomotor 2.

The upper shaft 7 is coupled to a Oldham-type coupling 15. This Oldham-type coupling 15 is needed because the upper shaft 7, such as will be described further below, performs lateral movements relative to the as such stationary driving shaft 6 of the first servomotor 2.

This Oldham-type coupling 15 is followed by a upper spur gear wheel 16 which meshes with a lower spur gear wheel 17 which is connected to the lower shaft 9.

The connection between the upper spur gear wheel 16 and the drive shaft 6 of the first servomotor 2 is performed by a multi-part clamping sleeve having a first clamping sleeve portion 18 and a second clamping sleeve portion 19.

The cooperation between the clamping sleeve portion 18, 19 proceeds by annular clamping members 20. The tensioning bolts are identified the reference numeral 21.

The upper spur gear wheel 16 is made integrally with the first clamping sleeve portion 18, wherewith a considerable saving on working parts is arrived at.

According to a further (not illustrated) embodiment the first electric servomotor 2 is directly connected to the second, lower feeding roller, whereby the first, upper feeding roller 8 is rotating by frictional engagement.

A further electric servomotor 28, a adjusting motor, is mounted on a threaded spindle housing 27 arranged on top of the housing 1. Its electronic control, i.e. its housing is identified by 29.

This electric servomotor 28 serves for the driving of a threaded spindle 30.

The electric servomotor 28 is to be considered merely as an example of a drive for the threaded spindle 30. It is also possible to have driving devices different from the electric servomotor 28. The drive shaft of the electric servomotor 28 is identified by the reference numeral 31. The connection between the drive shaft 31 of the electric servomotor 28 and the threaded spindle 30 is performed by a multi-part clamping sleeve which includes a first clamping sleeve portion 32, a second clamping sleeve portion 33 and annular clamping members 34. The clamping sleeve portions 32, 33 are clamped against each other by tensioning bolts 35.

The second clamping sleeve portion 33 is coupled to the threaded spindle 30 through a jaw clutch coupling 36. The threaded spindle 30 is in turn supported through roller bearings 37 and 38 in the threaded spindle housing 27 thus housing 1, respectively.

Accordingly, the threaded spindle 30 is supported free of play independently from the electric servomotor 28.

Because annular clamping members serve for the connection of the smooth motor shaft, a standard electric servomotor, thus no custom made design can be used.

A adjusting nut 39 is arranged on the threaded spindle 30.

A double arm lever 40 having a first arm 41 and a second arm 42 is supported on this adjusting nut 39. This lever 40 is termed in the present description first double arm lever 40.

Figure 3:
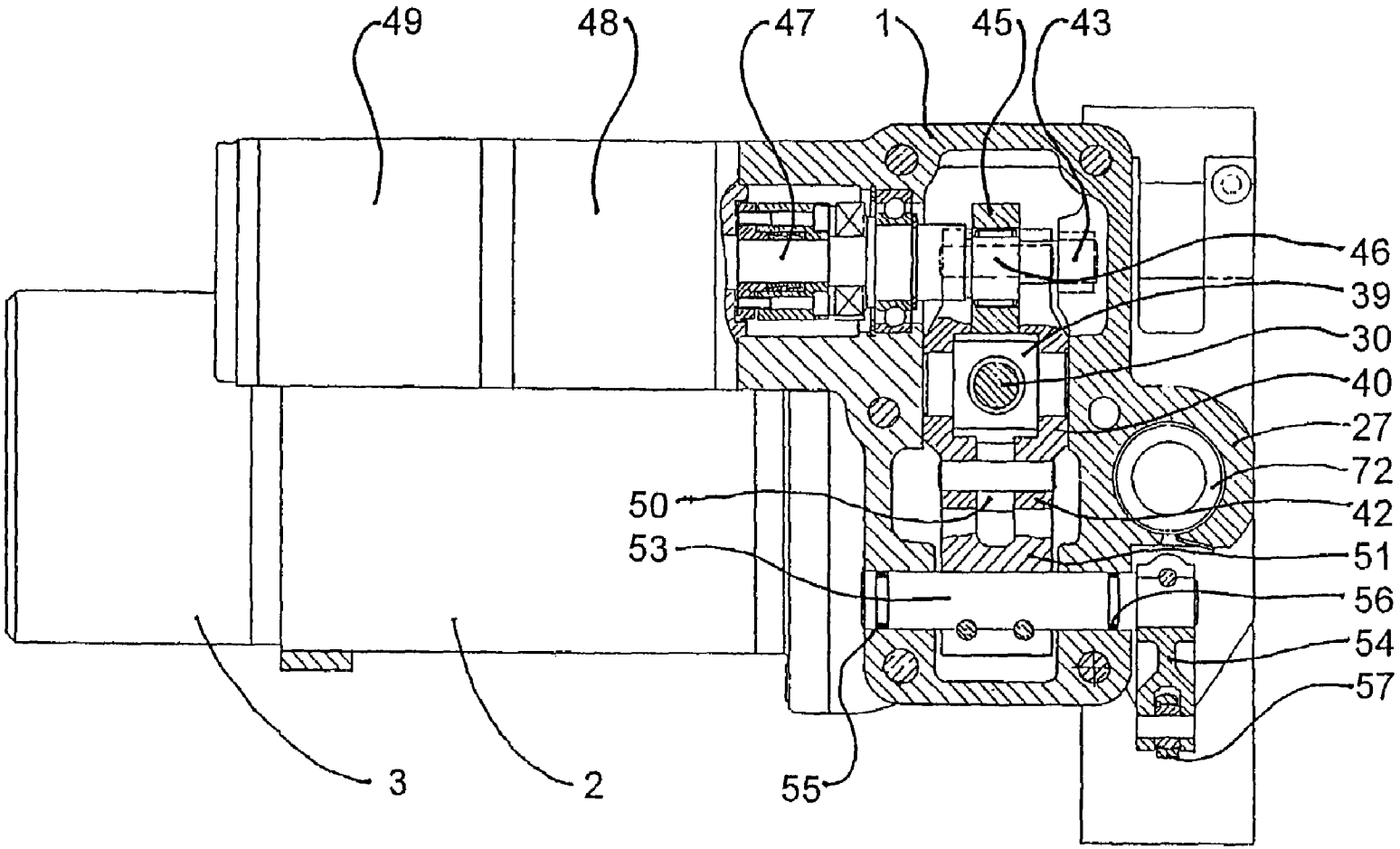
FIG. 3 is a section along line III—III of FIG. 1.

As can be seen in FIG. 3, the adjusting nut 39 has a square cross-sectional shape and is set in a inner space of the first double arm lever 40 which also has a square cross-sectional shape. Accordingly, the adjusting not 39 is secured against rotation.

A bolt 43 is inserted in the first arm 41 of the first double arm lever 40. This bolt 43 extends through a oblong hole 44 in a connecting rod 45.

This connecting rod 45 sits on eccenter disk 46 which is drivingly connected to a third driving motor 48, for instance a servomotor through a shaft 47. The control apparatus of the drive motor 48 is identified by the reference numeral 49.

The second arm 42 of the first double arm lever 40 is pivotally mounted through a fishplate to the first arm 51 of a second double arm lever 52. The second double arm lever 52 is supported on a shaft 53. The second arm 54 of the second double arm lever 52 is laterally clamped onto the shaft 53.

The shaft 53 is sealed in the threaded spindle housing 27 in a oiltight manner by means of seals 55, 56, so that a closed threaded spindle housing 27 is present as a closed lubrication oil chamber in which the threaded spindle 30 and the described structural member are located in a maintenance free manner in a closed chamber.

As specifically clearly can be seen in FIG. 3, the shaft 53 projects at one end out of the threaded spindle housing 27 and the second arm 54 is mounted in a clamped state onto this projecting end.

This second arm 54 is pivotally coupled to a upper rod portion 57 of a control rod 58 which a threadingly mounted to a lower rod portion 59. The described rod portion are secured against rotation by means of lock nuts 60 and 61, respectively.

These above described parts form a roller lifting device of which the function will be described further below.

Figure 13:
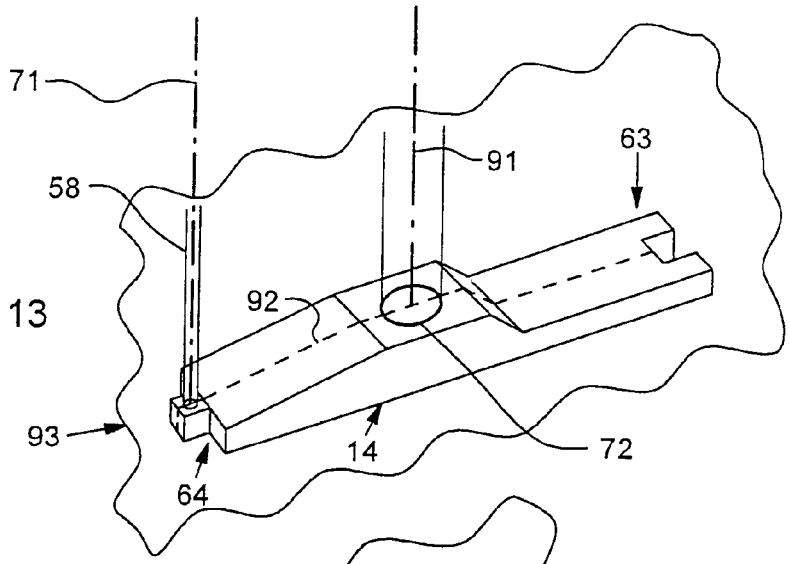
FIG. 13 illustrates schematically the rocker of the feeding apparatus, with the control rod and its longitudinal center axis, and with the pressure spring and its longitudinal center axis.

The control rod 58 is pivotally mounted at its lower end to the rocker 14, whereby in this description the point of the pivotal connection at the rocker 14 is designated as second end 64 of the rocker 14. This control rod 58 incorporates a longitudinal center axis 71 (FIG. 13).

The rocker 14 includes a first end 63 and a second end 64. The rocker 14 is now arranged at its first end 63 on a first end area 65 of a rocker shaft 62 and is rigidly mounted to same. This rocker shaft 62 is supported at its second end area 66 which is opposite the first end area 65 in the housing 1. This second end area 66 is of a converging design, whereby the portion with the larger diameter is immediately adjacent the first end area 65. The rocker shaft 62 is supported at the second end area through a first roller bearing 67 located at the portion with the larger diameter in the housing 1. At the portion with the smaller diameter the rocker shaft 62 is supported at its second end area through a further roller bearing 68 in the housing 1. The diameter of the first named roller bearing 67 is obviously larger than the diameter of the further roller bearing 68.

Accordingly, as clearly can be seen, the rocker 14 is carried at the housing in a overhang manner or state, respectively.

The first end 63 of this elongate designed rocker 14 is of a forked design, so that two fork tines 88, 89 are present and as clearly can be seen, the rocker 14 rests at these two fork tines 88, 89 on the rocker shaft 62, that it is clamped onto the rocker shaft.

Figure 4:
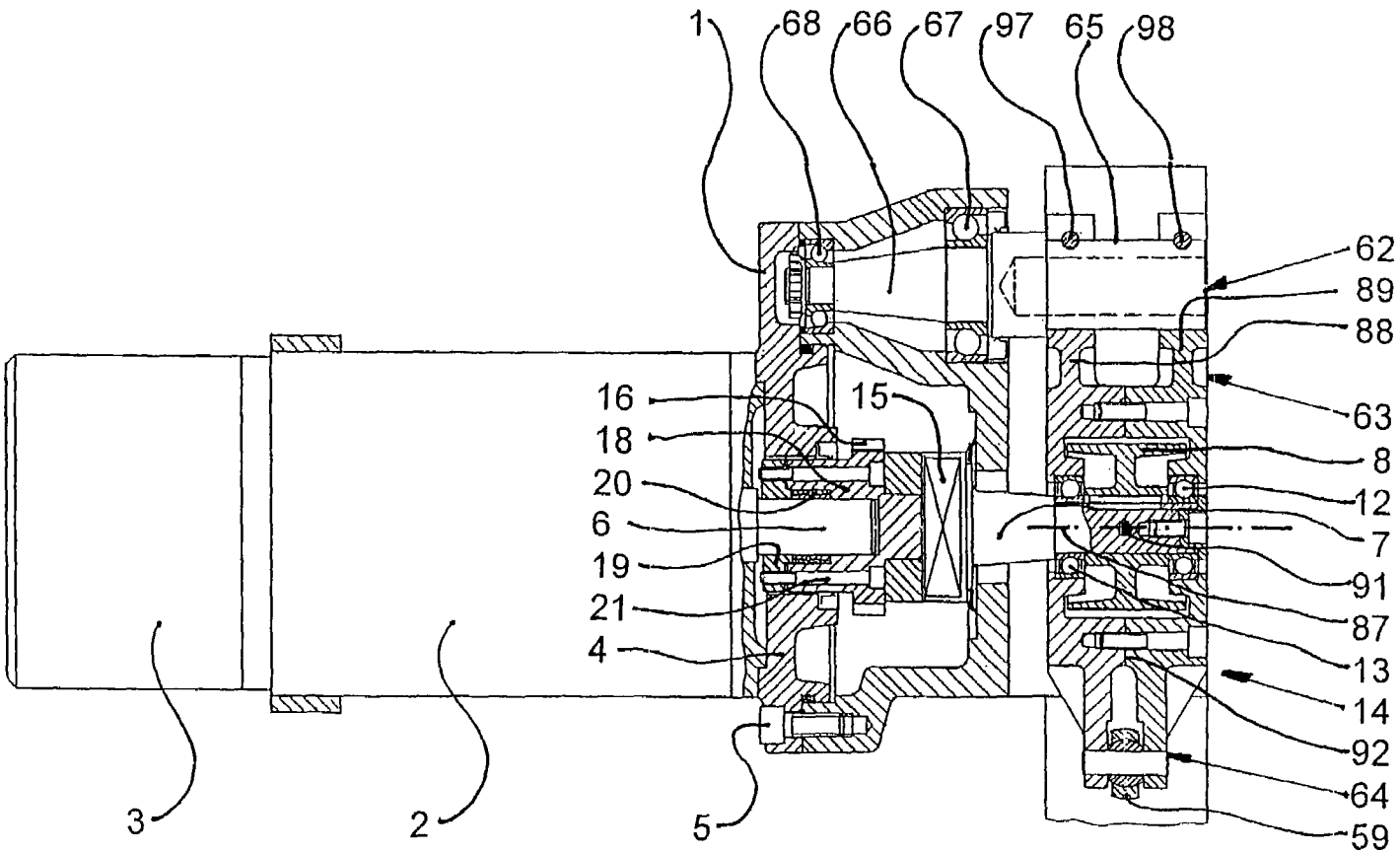
FIG. 4 is a section along line IV—IV of FIG. 1.
Figure 5:
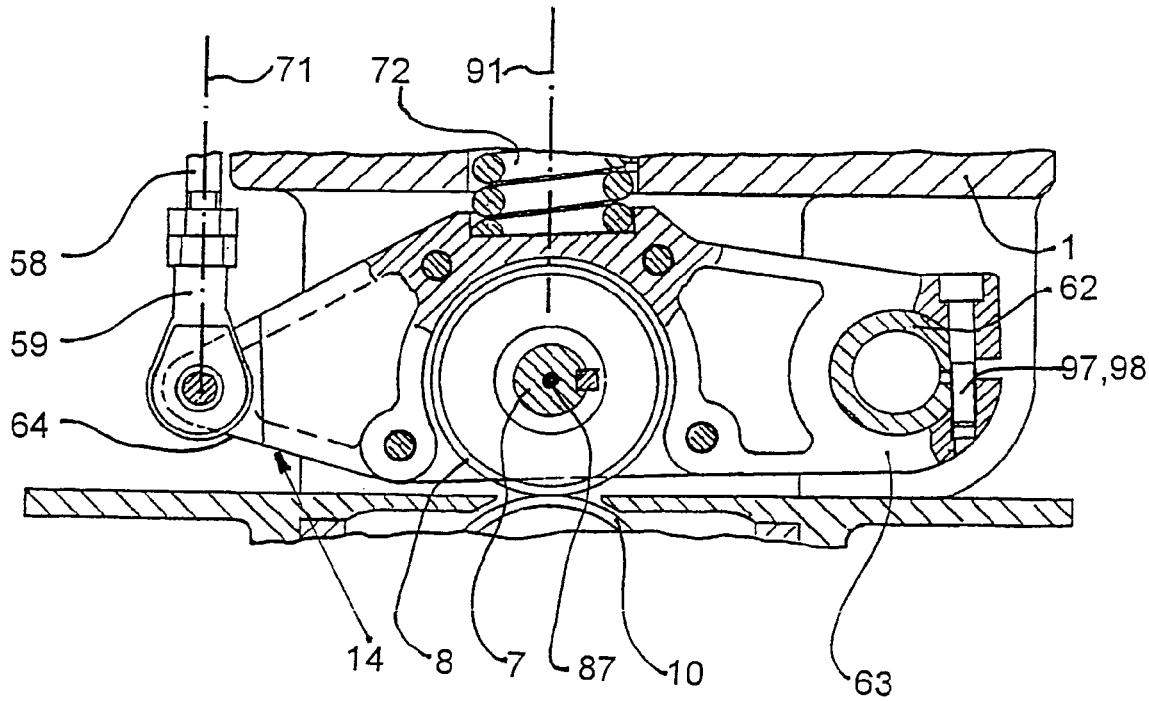
FIG. 5 illustrates a portion of FIG. 2 drawn on a enlarged scale, specifically the rocker and the structured members connected to the rocker.
Figure 6:
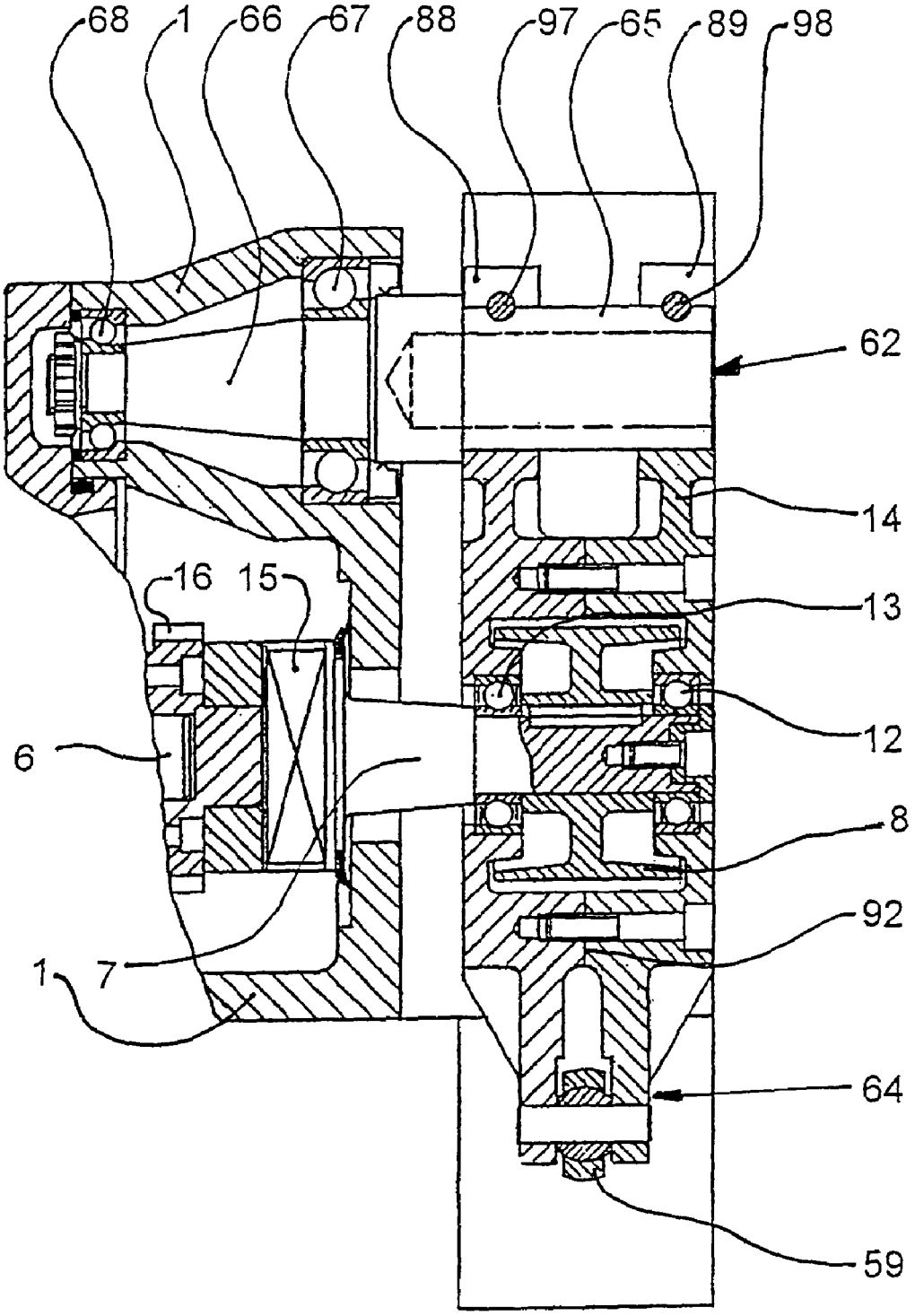
FIG. 6 illustrates a portion of FIG. 4, drawn on a enlarged scale.

These two fork tines 88, 89 are designed symmetrically relative to a longitudinal plane of symmetry 90 of the elongate rocker 14. See hereto FIG. 15. This longitudinal plane of symmetry 90 extends perpendicularly to the longitudinal center axis 87 of the upper feeding roller 8 supported in the rocker 14. As can specifically clearly been seen in FIG. 4, the rocker consists of two halves which are designed almost completely symmetrically to each other, which contact each other, whereby their planar area of contact extends in the longitudinal direction of the rocker 14. The longitudinal plane of symmetry 90 coincides with this area of contact. The partition line 92 which identifies the area of contact is illustrated in the FIGS. 13 and 16.

Thus, as can be seen, the rocker 14 with the upper feeding roller 8 supported in same can perform pivoting movements around the shaft 62. Accordingly, the first, upper feeding roller 8 can be moved against the second, lower feeding roller 10 with the metal strip 11 located thereon and is fed in the direction of the arrow B (see also FIG. 10), and away from same.

Figure 2:
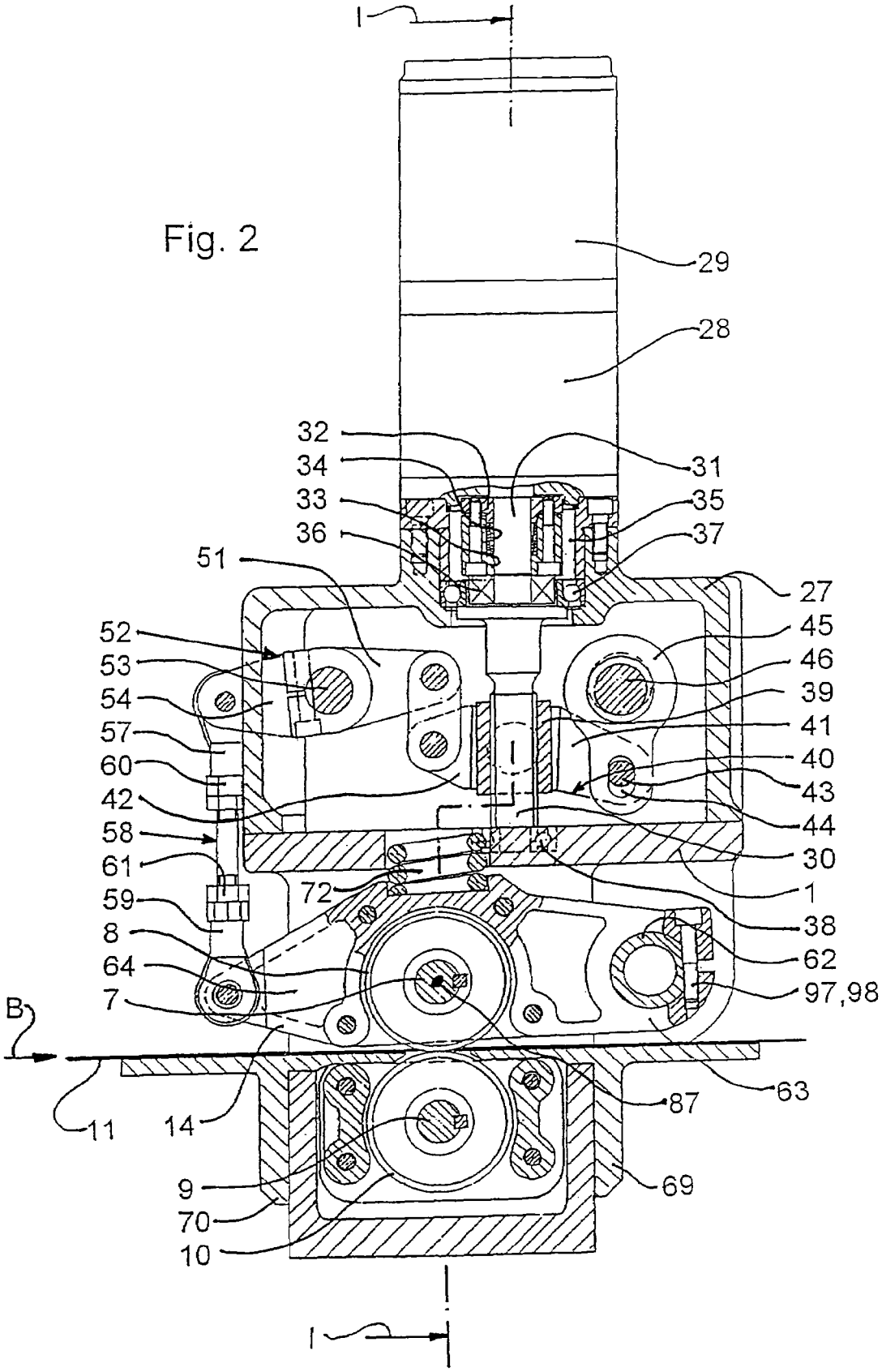
FIG. 2 is a section along line II—II of FIG. 1.

In FIG. 2 the strip entering table 70 and the strip exit table 69 are additionally depicted, on which tables the metal strip rests at both sides of the lower feeding roller 10.

The pressing on force of the pressing spring 72 is set by means of a threaded spindle in the threaded spindle housing 27.

The setting of the pressing on force proceeds by a reading of the position of a disk 74 at a scale 75 which disk rests on the pressing spring 72.

The pressing spring 72 is of a spiral design and comprises accordingly a longitudinal center axis 91 which is illustrated in FIGS. 13 to 16.

FIG. 13 illustrates schematically the rocker 14 inclusive the above mentioned partition line 92. Furthermore, the control rod 58 with its longitudinal center axis 71 which is pivotally mounted at the second end 64, is also illustrated. Also schematically illustrated is the pressing spring 72 with its longitudinal center axis 91. The longitudinal center axis 71 of the control rod 58 and the longitudinal center axis 91 of the pressing spring intersect the partition line 92. It thus can be seen clearly, that these two longitudinal center axes 71 and 91 define a geometrical plane which is identified by the reference numeral 93.

Figure 14:
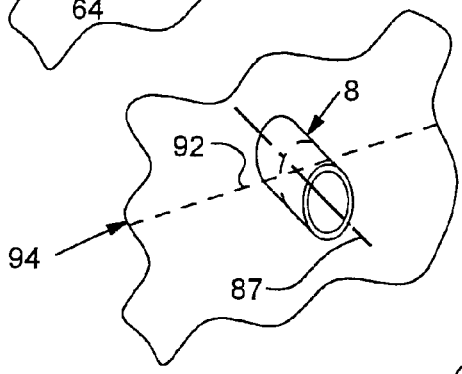
FIG. 14 illustrates schematically the upper feeding roller with its longitudinal center axis.

FIG. 14 illustrates schematically the first, upper feeding roller 8. The first, upper feeding roller 8 includes a longitudinal center axis 87 and is designed symmetrically relative to a plane of symmetry which extends perpendicularly relative to its longitudinal center axis.

Figure 15:
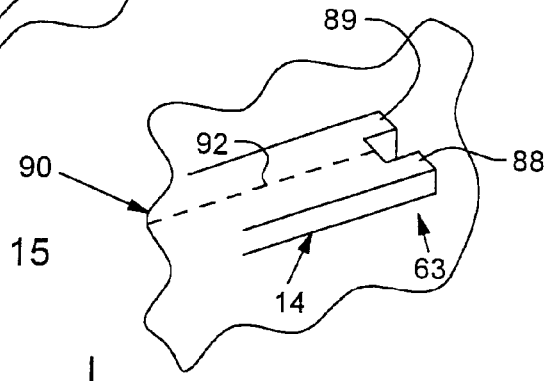
FIG. 15 illustrates schematically the first end of the rocker with the two symmetrically arranged fork tines.

FIG. 15 illustrates the first end 63 of the rocker 14 with the fork tines 88 and 89. The fork tines 88 and 89 are designed symmetrically relative to the longitudinal plane of symmetry 90 of the rocker 14 in which the partition line 92 extends.

Figure 16:
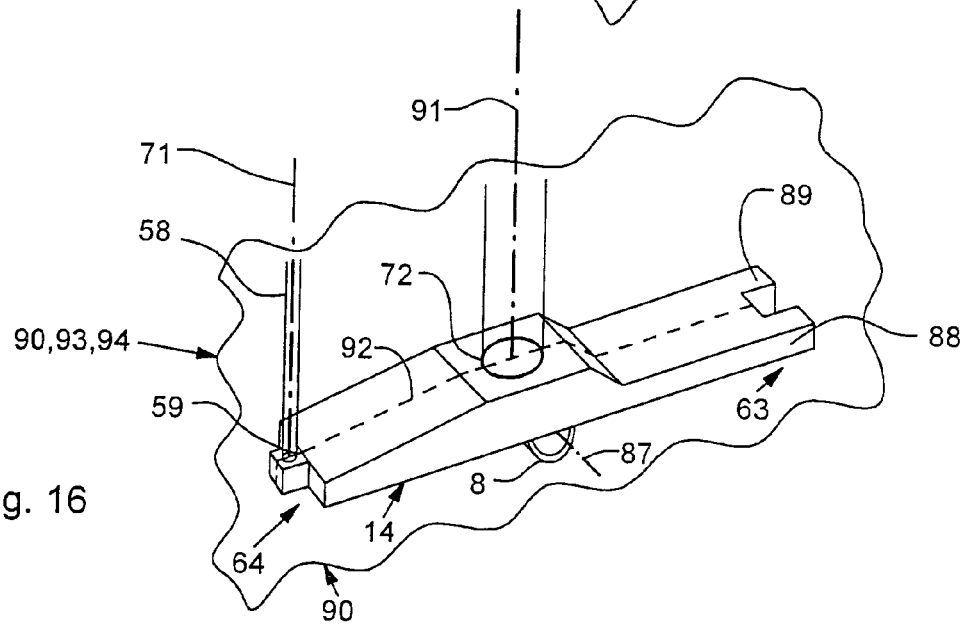
FIG. 16 illustrates schematically the rocker with the control rod, the pressure spring, the first end of the control rod and with the first, upper feeding roller.

It, therefore, can be seen such as illustrated in FIG. 16, that the geometrical plane 93 defined by the longitudinal center axes 71 and 91 coincides with the plane of symmetry 94 of the upper feeding roller 8.

These two planes coincide, furthermore, with the longitudinal plane of symmetry 90, such as illustrated in FIG. 16.

Thus, all points of attack of the forces which act onto the rocker 14 are located on a common rectilinear line. The effect of this situation is that no torsional forces act onto the rocker 14 which could cause a oblique orientation of the upper feeding roller 8 relative to the lower feeding roller 10. Therefore, these rollers 8 and 10 remain positioned precisely parallel to each other so that a precise feeding of the strip shaped blank 11 or metal strip, respectively, is ensured.

The described feeding apparatus is designed and adapted to feed a strip like blank 11, e.g. a metal strip to a press which is equipped with tools for an intermittent working the strip like blank.

Figure 10:
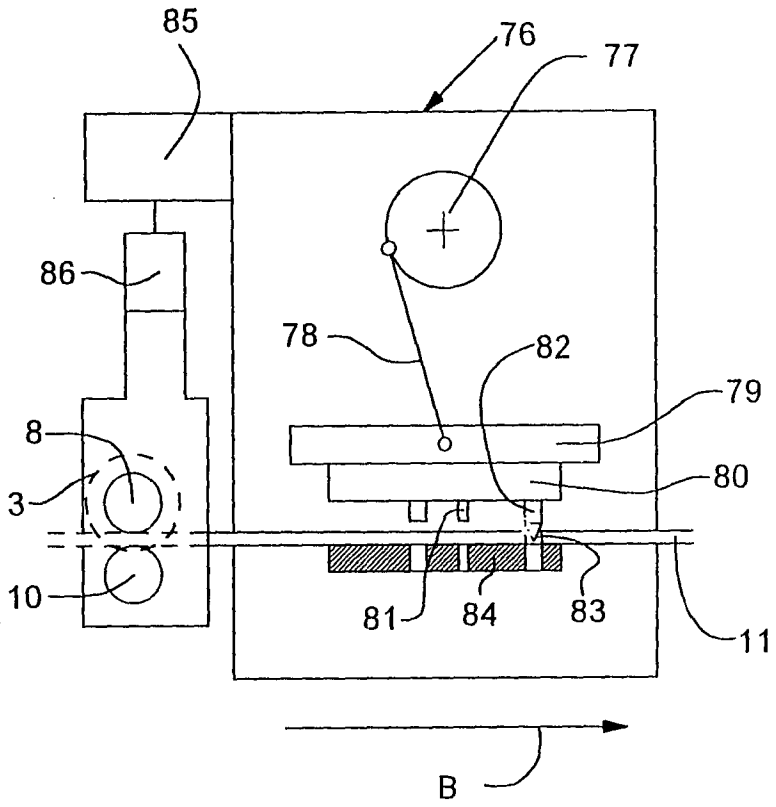
FIG. 10 illustrates schematically the feeding apparatus of the present invention cooperating with a punch press.

This feeding apparatus and the press 76, a punch press, allocated to the feeding apparatus are illustrated schematically in FIG. 10.

The punch press 76 has a drive 77. This drive 77 can, such as generally known to the person skilled in the art, include a electromotor which drives a crank shaft or a shaft with eccenter disk(s). This crank shaft or eccenter disk(s) is drivingly connected to a connecting rod 78. A punch 79 is pivotally mounted to this connecting rod 78. The punch carries an upper tool 80 which thus in operation of the punch press 76 is moved upwards and downwards. The upper tool 80 is equipped with working tools, e.g. punches 81. The upper tool 80 is, furthermore, equipped with positioning pins 82 each having a conical head portion 83.

Such as generally known, these positioning pins 82 are moved in operation prior the working tools contacting the strip, e.g. prior to the punch 81 contacting the strip like blank 11 for the actual working to be performed, into pre-punched holes in the blank 11 in order to precisely center the blank 11. The upper feeding roller is, thereby, momentarily lifted off the lower feeding roller 10 by a small distance so that no clamping force is exerted onto the strip shaped blank. This position of the upper feeding roller 8 is called in the art intermediate lifted position.

FIG. 10 illustrates, furthermore, the stationary lower tool 84 and the control device 85 of the punch press. The control device of the entire feeding apparatus, thus for all drives of the feeding apparatus, is identified generally by the reference numeral 86.

As can be seen, the control devices 85, 86 of the feeding apparatus and of the punch press 76 communicate with each other because the operation of the feeding apparatus must be made to depend from the operation of the punch press 76.

Figure 7:
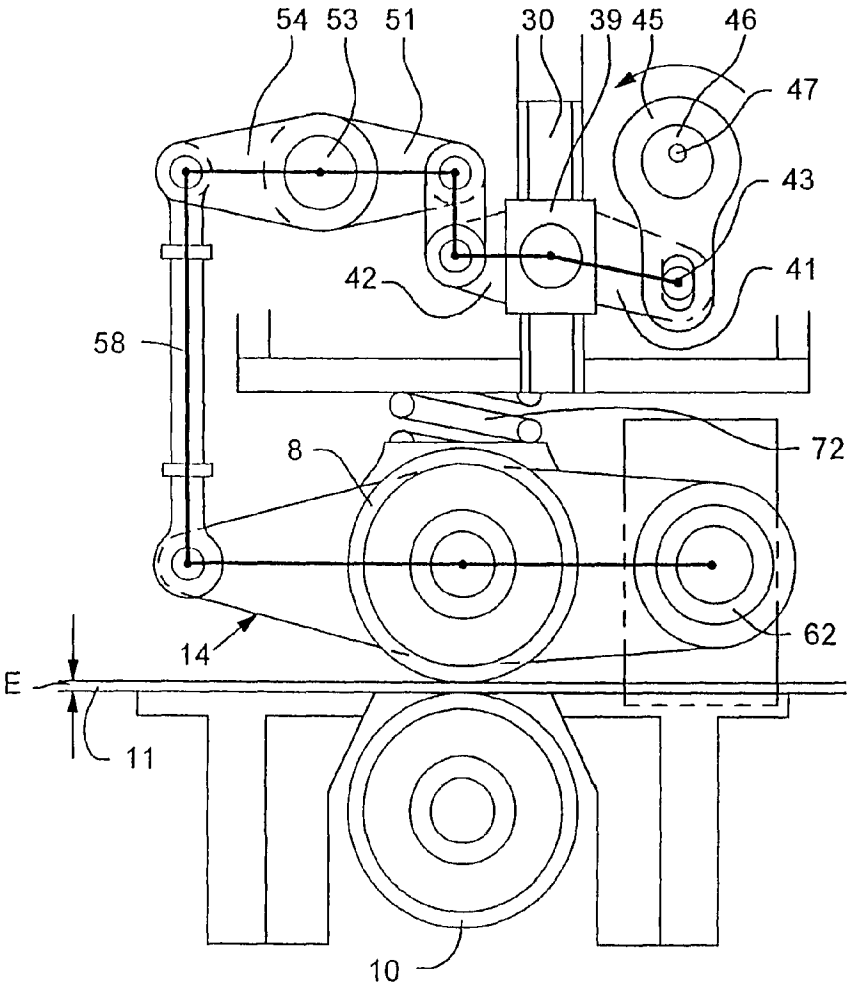
FIG. 7 is a simplified illustration according to FIG. 2, whereby the feeding device is illustrated in its feeding position during a continuous operation without a intermediate lifting.

In FIG. 7 the positions of the schematically illustrated parts of the feeding apparatus during the continuous operation are illustrated. During the continuous operation the first upper feeding roller 8 and the second, lower feeding roller 10, which are driven by the electric servomotor 2, rotate intermittently so that the strip shaped blank 11 is fed intermittently, step by step, such as generally known. The (electronic) control devices of the feeding apparatus cooperate, thereby, with the (electronic) control device of the punch press 76, see hereto FIG. 10. The punch press 76 includes a moveable upper tool 80 and a stationary lower tool 84. The upper tool 80 is connected to a punch 79. The punch 79 is driven by a rotating drive 77, e.g. electromotor and crank shaft or eccenter shaft via a connecting rod 78, whereby the connecting rod 78 illustrates in the drawing purely schematically the driving connection between the drive 77 and the punch 79.

Thus, the punch is moveable between a upper dead center position and a bottom dead center position.

The measure of the thickness of the strip shaped blank 11 and accordingly the distance between the first, upper feeding roller 8 and the second, lower feeding roller 10, when both these rollers contact the blank, is illustrated in FIG. 7 by the letter E.

In order to insert a new, i.e. fresh strip shaped blank 11, thus for instance a metal strip between the first, upper feeding roller 8 and the second, lower feeding roller 10 it is necessary to lift the upper feeding roller 8 so that it is located at a predetermined distance D above the lower feeding roller 10, which distance D is larger than the distance E. This distance D and the lifted position of the first, upper feeding roller are illustrated in FIG. 8.

Figure 8:
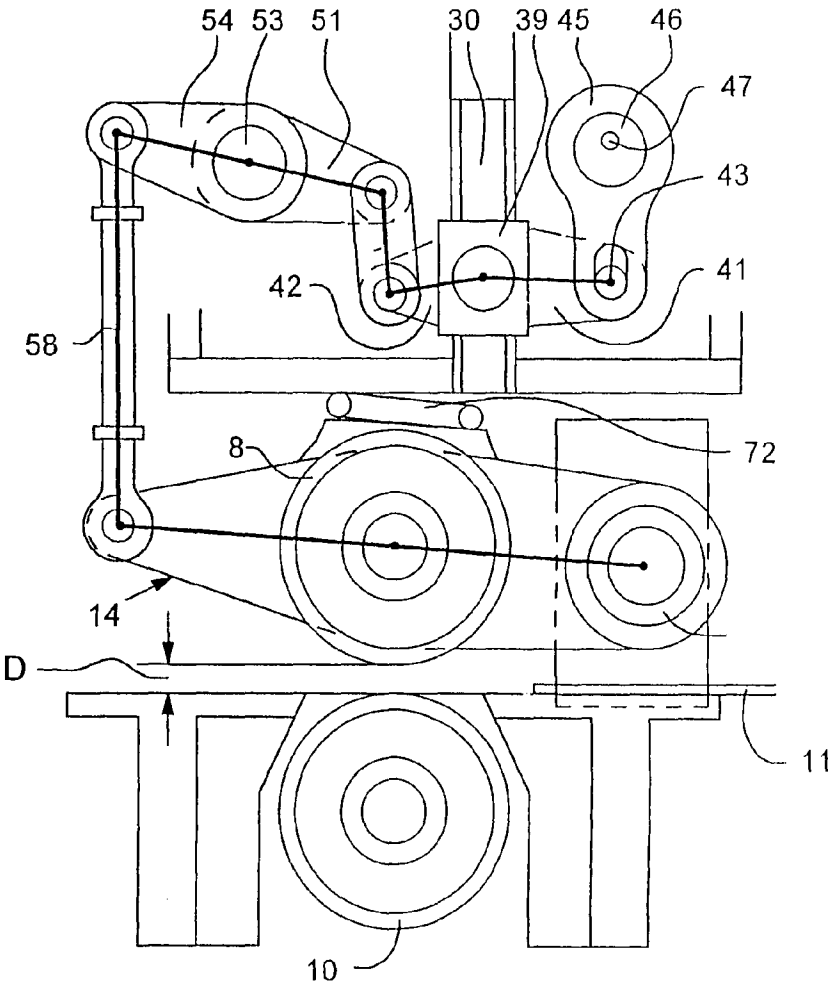
FIG. 8 is a simplified illustration according to FIG. 2, whereby the feeding device is illustrated in its high lifted position.

The art calls this position of the first, upper feeding roller 8 high lift position (FIG. 8).

In order to set this high lift position the control devices 86 and 85 of the feeding apparatus and of the punch press 76 are operated in such a manner, that the punch 79 of the punch press is at a location remote from its bottom dead center position and that the connecting rod (FIG. 2) is at a location remote from its upper dead center position. In which specific locations the punch 79 and the connecting rod 45 are positioned is of no importance as long as the punch is not in its bottom dead center position. Generally, and this is known for the person skilled in the art, the control devices 86 and 85 of the feeding apparatus and of the punch press are, however, operated such, that the punch 79 of the punch press 76 is located in the upper dead center position and that the connecting rod 45 is in the bottom dead center position. The now following description proceeds from these latter dead center positions. When the said dead center positions are arrived at the adjusting nut 39 is lowered by a corresponding rotating of the threaded spindle 30.

The bolt 43 rests due to the force exerted by the pressing spring 72 via the rocker 14 and the lever devices 40 and 52 against the bottom end of the oblong hole 44.

By the downwards proceeding movement of the adjusting nut 39 the first arm 41 of the first double arm lever device 40 is pivoted upwards and its second arm is pivoted downwards. This second arm 42 pulls the first arm 51 of the second double arm lever device 52 also downwards. Conclusively, the second arm 54 of the second double arm lever device 52 is pivoted upwards. Thus, the control rod unit 57-59 is lifted upwards and accordingly the rocker 14 with the first, upper feeding roller 8 supported in the rocker 14 is pivoted into the high lift position of the first, upper feeding roller 8, in which position it is located at the above mentioned distance D at a distance from the second, lower feeding roller 10, so that a new strip like blank 11 can be inserted.

For a continuous operation the upper feeding roller 8 must lie on the strip shaped blank, whereby a clamping force for a frictional engaging of the strip shaped blank must be exerted by the first, upper feeding roller 8 and the second, lower feeding roller 10.

This clamping force is produced by the pressing spring 72. Accordingly, the bolt 43 is not to rest any longer against the lower end of the oblong hole 44. In order to achieve this, the adjusting nut 39 is lowered from the high lift position until the first, upper feeding roller 8 rests on the strip shaped blank 11. By a continued lowering movement of the adjusting nut 39 the first double arm lever 40 is forced to perform a pivoting movement because the rocker does no longer move since the first, upper feeding roller 8 is held resting on the strip shaped blank 11 by the action of the pressing spring 72. Mentioned pivoting movement causes a upwards pivoting of the first arm 41 with the bolt 43, so that the bolt 43 comes to be located in the oblong hole 44 at a position between its ends. This means that the connecting rod 45 can perform basically lifting movements without any influence acting onto the bolt 43.

Figure 9:
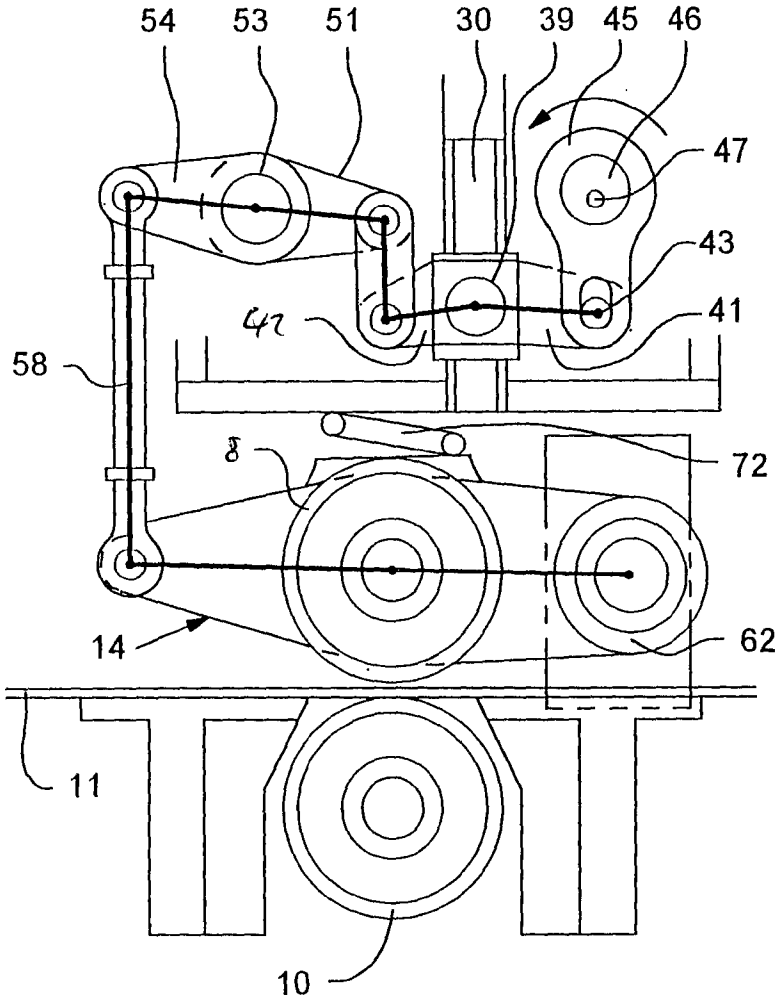
FIG. 9 is a simplified illustration according to FIG. 2, whereby the feeding device is illustrated with intermediate lifted position.

A further movement during the operation of the feeding apparatus with the punch press is the intermediate lifting movement (FIG. 9).

It has been mentioned above that a upper tool 80 of a punch press can be equipped with positioning pins 82 for a precise positioning of the strip shaped blank.

In order to make such a positioning possible, the strip shaped blank 11 must lie during a short time span completely freely. This means that the first, upper feeding roller 8 must be lifted off the strip shaped blank during a short time span into a intermediate lifted position.

This intermediate lifted position is caused by the connecting rod 45.

Firstly, the punch press 76 is operated into the stroke position at which the intermediate lifted position shall take place and in which position the conical head portion 83 of the positioning pins 82 have been immersed partly into the positioning holes. This position is illustrated in FIG. 10.

In this position the punch 79 of the punch press 76 is located in a angular position ahead of the bottom dead center position. Accordingly, a angular distance is present between this angular position and the bottom dead center position.

The angular distance mentioned in connection with the punch press equals the angular distance present at the feeding apparatus.

Now, the adjusting nut 39 is moved downwards by a rotating of the threaded spindle 30. Due to this the bolt 43 will come to rest against the lower end of the oblong hole 44. The adjusting nut 39 is then moved further downwards, so that due to the now occurring pivoting movements of the lever devices and the rocker 14 the first, upper feeding roller 8 lets the strip like blank go freely. In this free state the strip like blank lies loose in a state that it just can be moved manually. This position of the adjusting nut 39 is stored together with the respective angular position in the control devices 85 and 86.

This means that during a continuous operating the connecting rod 45 with its oblong hole 44 can move freely relative to the bolt 43 without any influence on the bolt, with the exception, that when the connecting rod 45 reaches the above mentioned angular position ahead of the upper dead center position of the connecting rod 45, the bottom end of the oblong hole 44 comes to contact the bolt 43 and lifts it upwards, and after the upper dead center position has been moved through, the bolt 43 is again released.

Because the rocker 14 is supported only at one side in a overhang state it is possible to produce with two of the described feeding apparatuses a twin feeding apparatus, in that two such feeding apparatuses are arranged with their feeding rollers facing each other, that is adjacent each other.

Figure 11:
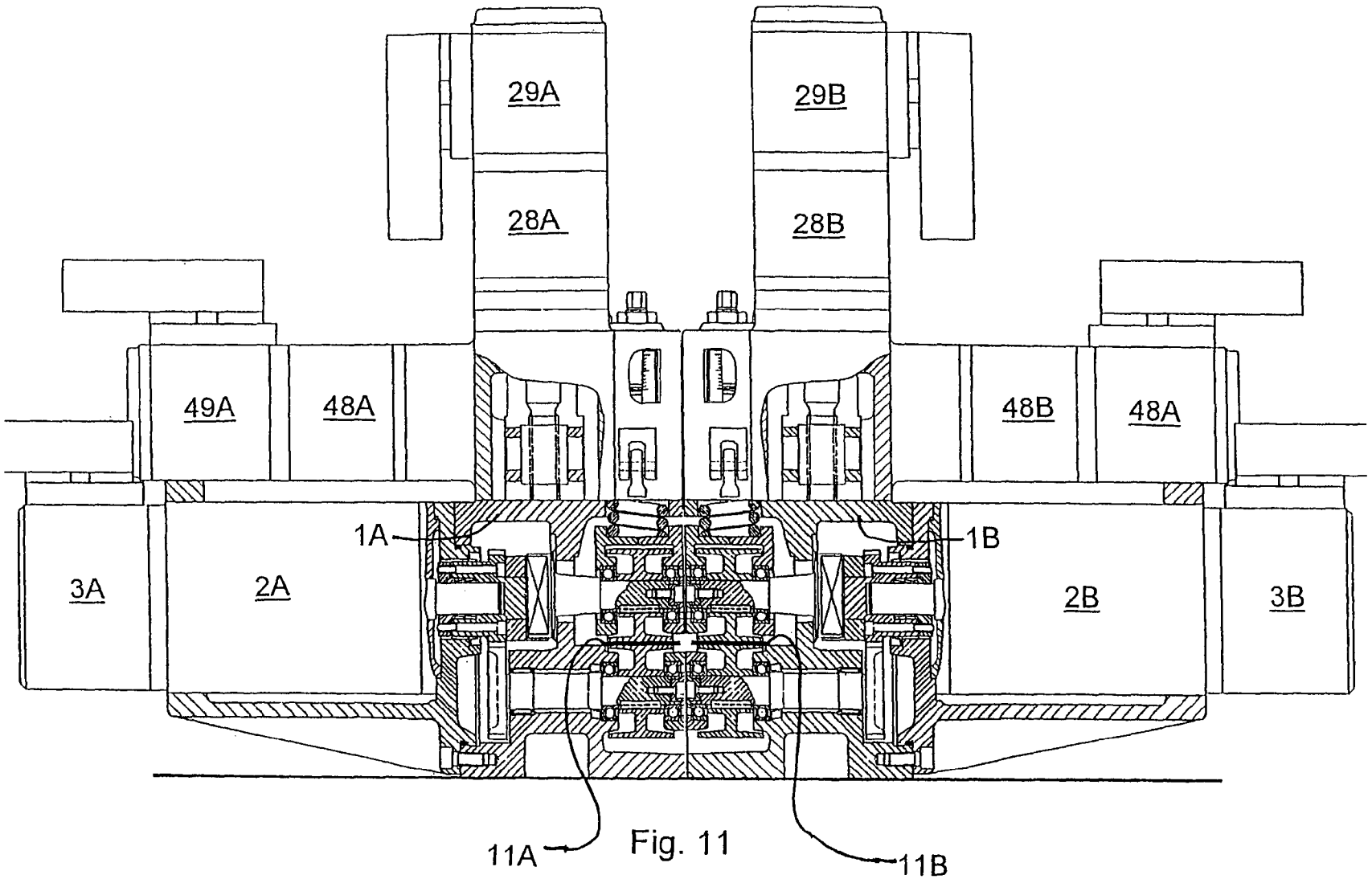
FIG. 11 illustrates a twin design for a feeding of two strip like blanks.

A first embodiment of a twin feeding apparatus is illustrated in FIG. 11.

The design of the two individual feeding apparatuses is the same as the design of the feeding apparatus described with reference to the earlier mentioned Figures, specifically FIG. 1, whereby corresponding structural units of the feeding apparatus illustrated on the left side in FIG. 11 are identified by the letter A, and those of the feeding apparatus illustrated on the right side are identified by the letter B.

Now, it is possible to feed two strip shaped blanks (11A, 11B, thus e.g. metal strips) by this twin feeding apparatus. Thus, the two metal strips can be fed, advanced completely independent from each other. Furthermore, these metal strips 11A, 11B can completely differ from each other regarding thickness, width, length of a feeding step and also their material. It obviously is also possible to operate with only one metal strip which is engaged at both its sides by the feeding rollers of both individual feeding devices.

Figure 12:
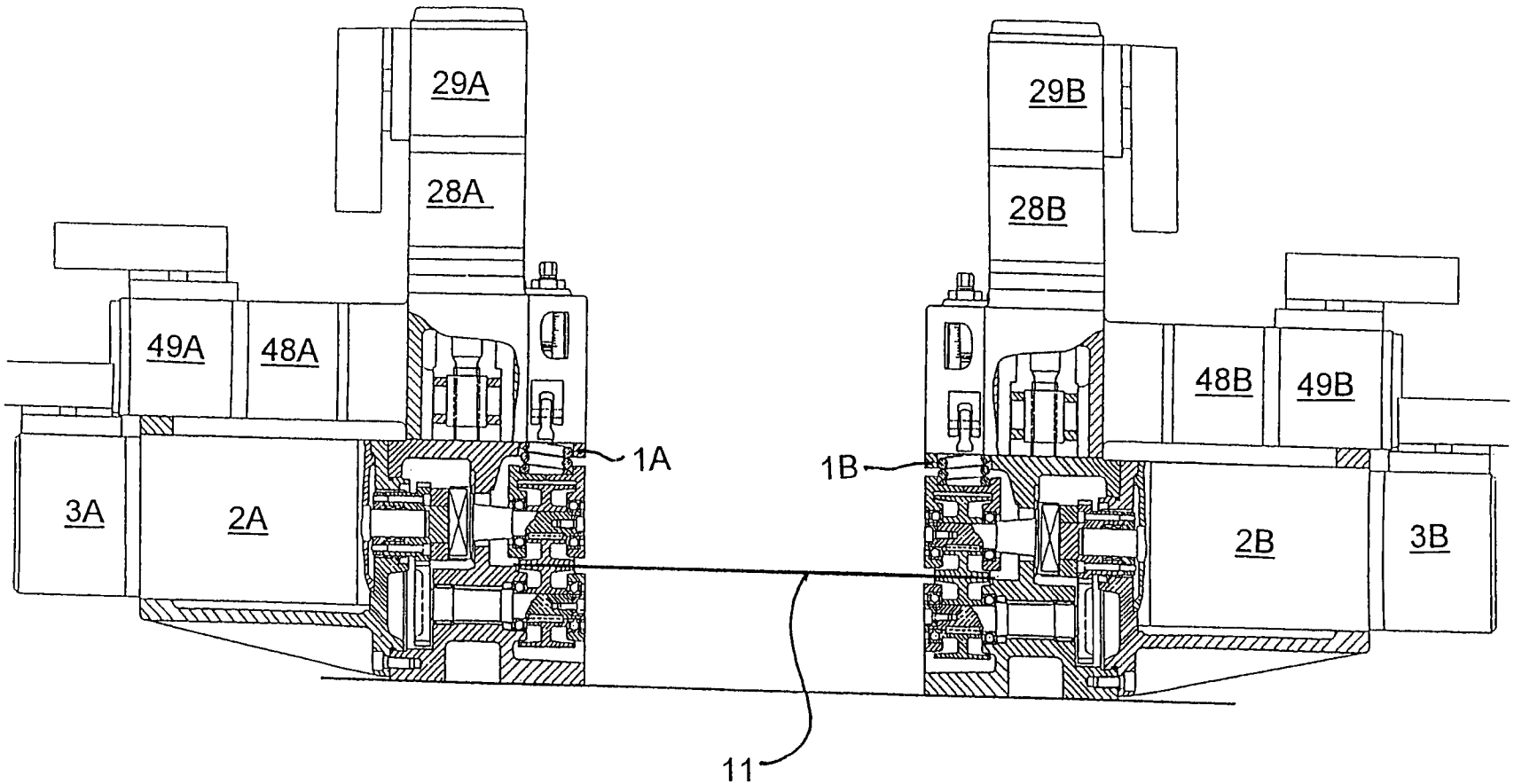
FIG. 12 illustrates a twin design for a feeding of a extremely broad strip like blank.

FIG. 12 illustrates a embodiment of a twin feeding device which is applied in case of extreme strip widths. Again, the structural units corresponding to those of FIG. 1 are identified by the letters A and B.

The broad metal strip 11 is engaged at both longitudinal edges by corresponding feeding rollers of the feeding apparatuses which face each other, which feeding apparatuses operate obviously in synchronism.

While these are shown and describes present preferred embodiments of the invention it is to be distinctly understood that the invention is not limited thereto, but may be otherwise variously embodied and practiced within the scope of the following claims.

What is claimed is:

1. An apparatus for an intermittent feeding of a strip shaped blank to a press equipped with tools for an intermittent working of the strip shaped blank, said apparatus having a housing, a first feeding roller and a second feeding roller, wherein;

said feeding rollers are adapted to accommodate the said strip shaped blank arranged between the said feeding rollers for said feeding;

a first intermittently operating electric servomotor is drivingly connected to at least said first feeding roller;

said first feeding roller includes a longitudinal center axis and is designed symmetrically relative to a plane of symmetry extending perpendicularly to said longitudinal center axis;

an elongate rocker includes a first end and a second end opposite said first end, said first feeding roller being supported for rotation in by said rocker;

said second feeding roller is arranged on a roller shaft and is rigidly connected thereto;

said first end of said rocker is arranged on a first end area of a rocker shaft and is rigidly connected thereto;

said rocker shaft is mounted for rotation at a second end area opposite the first end area in said housing so that said rocker is supported in an overhung state;

a means for a lifting off said first feeding roller, includes a control rod pivotally mounted to said second end of said rocker, said control rod having a longitudinal center axis;

a feeding roller pressing on device which includes a spiral pressing spring which rests at one ends on said rocker and includes a further longitudinal center axis; and said control rod, said spiral pressing spring and said first feeding roller are arranged relative to each other in such positions that said longitudinal center axis of said control rod and said longitudinal center axis of said spiral pressuring spring define a geometrical plane which coincides with said plane of symmetry of said first feeding roller.

2. The feeding apparatus of claim 1, wherein said first end of said elongate rocker is of a forked design having two fork tines; which fork tines are designed symmetrically relative to a longitudinal plane of symmetry of said elongate rocker; and wherein said elongate rocker is arranged relative to said control rod, said spiral pressing spring and said first feeding roller in such a manner, that its plane of symmetry coincides also with said geometrical plane which coincides with said plane of symmetry of said first feeding roller.

3. The feeding apparatus of claim 1, comprising a threaded spindle housing located on said housing; further comprising an adjusting motor, a threaded spindle, a control apparatus and an adjusting nut arranged on said threaded spindle and adapted to be displaced along said threaded spindle by a rotating of said threaded spindle; and comprising an eccentric disk which is driven by an electromotor, and a connecting rod supported on said eccentric disk, which connecting rod includes at an end remote from said eccentric disk an oblong hole extending at least approximately parallel to said threaded spindle; further comprising a first double arm lever device which is supported on said adjusting nut, and a second double arm lever device supported on a shaft which in turn is supported in said threaded spindle housing; which first double arm lever device includes a first arm and a second arm, which first arm engages said connecting rod and which said second arm is pivotally mounted to a fishplate which in turn is pivotally mounted to a first arm of said second double arm lever device which has a second arm which is pivotally mounted to a control rod unit which is pivotally mounted to said rocker; and comprising a pressure spring located between said rocker and said threaded spindle housing and adapted to press said rocker with an upper roller shaft supported in same and supporting said upper feeding roller against said lower feeding roller shaft with said second lower feeding roller.

4. The feeding apparatus of claim 3, wherein said threaded spindle is supported through roller bearings free of play in said threaded spindle housing and said housing, wherewith said threaded spindle is precisely positioned.

5. The feeding apparatus of claim 4, wherein said adjusting motor is drivingly coupled to said threaded spindle through a multi-part clamping sleeve followed by a jaw clutch coupling.

6. The feeding apparatus of claim 3, wherein said second arm f said second double arm lever device is pivotally mounted through a ball end connection to said control rod which forms a part of said control rod unit.

7. The feeding apparatus of claim 6, wherein said second shaft supported in said threaded spindle housing is sealed against lubrication oil leakage by sealing rings oil tight against said threaded spindle housing, wherewith said threaded spindle housing forms a closed oil chamber.

8. The feeding apparatus of claim 7, wherein said control rod unit includes rod portions which are threaded together allowing a length adjustment of said control rod unit.

9. The feeding apparatus of claim 3, wherein said first arm of said first double arm lever device engages said connecting rod through a bolt which projects through said oblong hole.

10. The feeding apparatus of claim 1, wherein said second end area of said rocker shaft is of a converging shape and has a first portion facing said first end area and a second portion remote from said end area, which first portion has a larger diameter than the second portion and the first portion is supported in said housing by a first roller bearing and said second portion is supported in said housing by a second roller bearing.

11. The feeding apparatus of claim 2, wherein said rocker is mounted at its fork tines by means of a clamped mounting to the first end area of said rocker shaft, for which reason each fork tine includes a slotted end area in which a threaded bolt is received.

* * * * *